US007717431B2

(12) United States Patent
Pettis

(10) Patent No.: US 7,717,431 B2
(45) Date of Patent: May 18, 2010

(54) TABLE-TOP FOOTBALL KICKING GAME

(76) Inventor: Clinton Pettis, 8444 Kings Trail Dr., Cordova, TN (US) 38016

( * ) Notice: Subject to any disclaimer, the term of this patent is extended or adjusted under 35 U.S.C. 154(b) by 0 days.

(21) Appl. No.: 12/287,284

(22) Filed: Oct. 8, 2008

(65) Prior Publication Data

US 2009/0096170 A1 Apr. 16, 2009

Related U.S. Application Data

(60) Provisional application No. 60/978,774, filed on Oct. 10, 2007.

(51) Int. Cl.
*A63F 7/20* (2006.01)

(52) U.S. Cl. ..... 273/317.5

(58) Field of Classification Search ..... 273/317, 273/317.1, 317.5
See application file for complete search history.

(56) References Cited

U.S. PATENT DOCUMENTS

| | | | | | |
|---|---|---|---|---|---|
| 1,145,955 | A | * | 7/1915 | Wittstein | 273/317.5 |
| 1,663,404 | A | * | 3/1928 | Hands | 273/317.5 |
| 1,929,757 | A | * | 10/1933 | Sargent | 273/317.5 |
| 1,954,838 | A | * | 4/1934 | Woolsey et al. | 273/317.5 |
| 2,069,514 | A | * | 2/1937 | Wylie | 273/317.5 |
| 2,140,193 | A | * | 12/1938 | Weinberger | 273/317.5 |
| 3,888,485 | A | * | 6/1975 | Conti | 273/317.5 |
| 3,911,616 | A | * | 10/1975 | Pelfrey | 446/333 |
| 4,183,531 | A | | 1/1980 | White | |
| 4,306,720 | A | * | 12/1981 | Selengowski et al. | 273/317.5 |
| 4,733,867 | A | | 3/1988 | Kemp et al. | |
| 4,927,145 | A | | 5/1990 | Davis | |
| 5,110,127 | A | * | 5/1992 | Potter | 273/317.3 |
| 5,451,050 | A | * | 9/1995 | Charles | 273/317.5 |
| 5,570,888 | A | | 11/1996 | Robinson et al. | |
| 5,851,012 | A | * | 12/1998 | Langieri et al. | 273/317.1 |
| 6,209,876 | B1 | | 4/2001 | Franklin | |
| 2009/0096170 | A1 | * | 4/2009 | Pettis | 273/317.5 |

* cited by examiner

*Primary Examiner*—Raleigh W. Chiu
(74) *Attorney, Agent, or Firm*—James Ray & Assoc

(57) ABSTRACT

A table-top football kicking game includes a substantially planar and rectangular playing surface having at least two lines extending laterally, and at least one set of goal post uprights attached substantially perpendicular to and proximal ends of the rectangular playing surface. Also included are a toy oblong football of proportional length and a kicking device movably placed on the rectangular playing surface for propelling the toy oblong football off of said playing surface toward and preferably through the goal post uprights.

10 Claims, 3 Drawing Sheets

TABLE-TOP FOOTBALL KICKING GAME

CROSS REFERENCE TO RELATED APPLICATION

This patent application is related to and claims priority from U.S. Provisional Patent Application Ser. No. 60/978,774 filed Oct. 10, 2007.

FIELD OF THE INVENTION

The present invention relates, in general, to table-top sports games and, more particularly, this invention relates to a table-top toy football kicking game.

BACKGROUND OF THE INVENTION

Prior to the conception and development of the present invention, table-top sports games simulating real sports action have been in existence for many decades. A number of these are for simulating American football. Wittstein in U.S. Pat. No. 1,145,955 discloses a mechanical football player for a tabletop football game that uses spinners to simulate playing football wherein kicking is just an occasional part of the game. There are various versions of table-top football that involve players using fingers to flick a small item representing a football for the kicking part of the game. Examples of this can be found in U.S. Pat. Nos. 4,733,867, 5,451,050, 5,570,888 and 6,209,876. The game disclosed in the U.S. Pat. No. 4,733,867 patent also can be adapted for rugby play. None of the aforementioned prior art incorporates a mechanical kicker used in a kicking only football contest.

SUMMARY OF THE INVENTION

The present invention provides a table-top football kicking game which includes a substantially planar and rectangular playing surface having at least three lines extending laterally, and at least one set of goal post uprights attached substantially perpendicular and proximal ends of the rectangular playing surface. Also included are a toy oblong football of proportional length and a kicking means movably placed on the rectangular playing surface for propelling the toy oblong football off of said playing surface toward and preferably through the goal post uprights.

In an alternative embodiment of the present invention, the goal post uprights at one end are spaced differently than those at the other end to allow for a variable degree of difficulty. Additional options are backstop nets and a score-keeping device.

OBJECTS OF THE INVENTION

It is, therefore, one of the primary objects of the present invention to provide an enjoyable table-top game based on football kicking.

Another object of the present invention is to provide a table-top game of skill in kicking a toy football for both accuracy and distance.

Still another object of the present invention is to provide a novel miniature football kicking device for a table-top game.

Yet another object of the present invention is to provide a table-top football game with amenities such as back-stop nets and a scoreboard.

In addition to the various objects and advantages of the present invention described with some degree of specificity above, it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
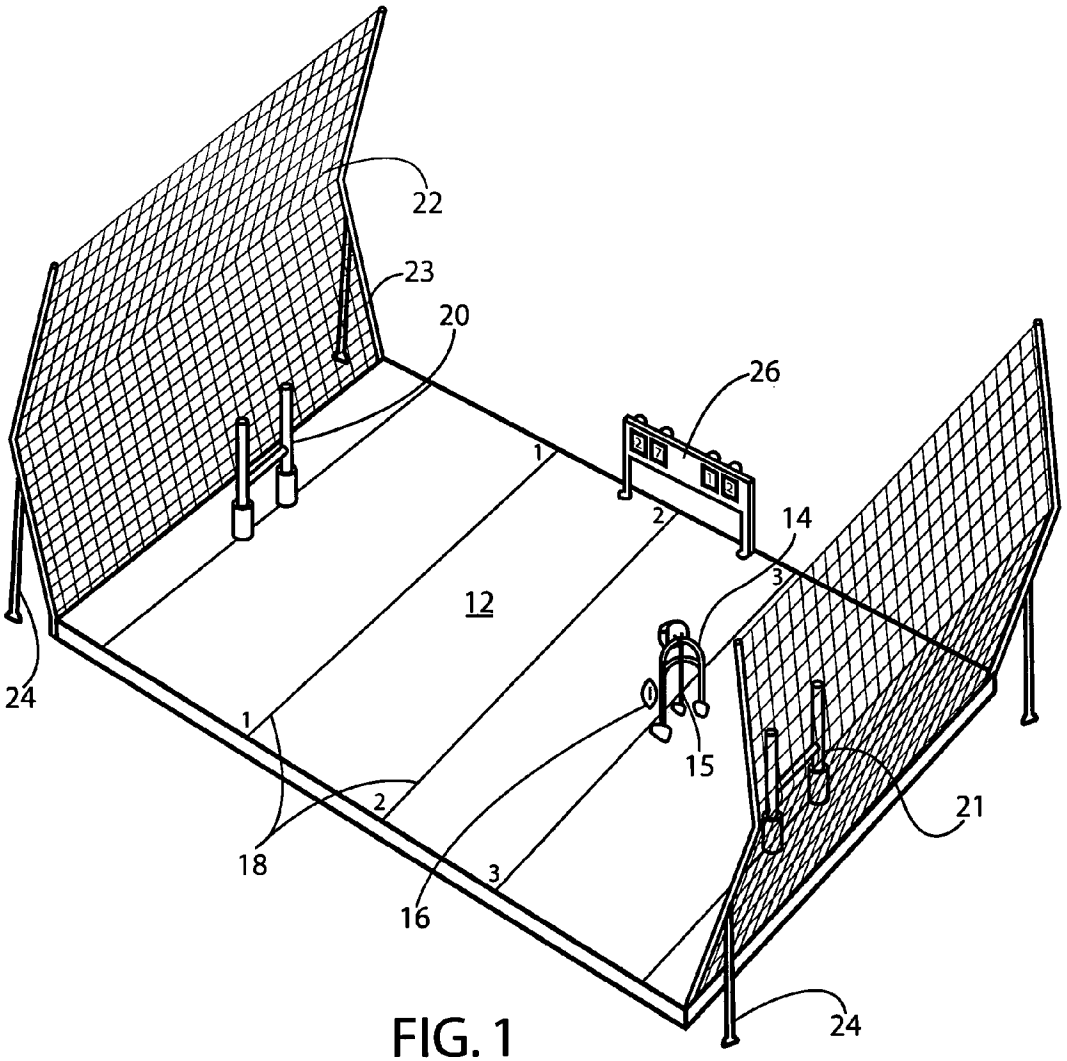
FIG. 1 is a perspective overview of the table-top football field with a kicker.

DETAILED DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Referring initially to FIG. 1, a perspective overview of the invention 10 is provided. A substantially flat and rectangular playing field 12 is sized for fitting on common kitchen and dining room tables. The top of the surface may optionally be covered with a synthetic grass mat. There are goal posts 20 and 21 adjacent each end, and the uprights of each are preferably but optionally spaced differently so that a higher degree of difficulty can be introduced in the latter stages of a game as the players become more accomplished. For example, the uprights on goal post 21 may be two inches wider than that of goal post 20, and both players would kick in the direction of 21 in the first half, and then toward goal post 20 in the second half. In either case, the playing surface 12 has three lateral lines 18 at least part way across the width of the field, not counting any end lines near the goal posts 20 and 21. These lines 18 mark the kicking location for the first and succeeding kicks of a player's turn. A player starts at the line 18 closest the target goal post. The miniature toy football 16 is teed up at the designated first of lines 18 and the mechanical kicker 14 is used to propel the football up and through the uprights of a goal post 20 or 21. If successful, the player continues at the second, then third line, and then back to the first line, etc, until a miss occurs. Then the opponent starts at the first line and tries to make as many field goals in a row as they can. Each successful kick is awarded three points for that team or person on the scoreboard 26. The lines are spaced approximately 4 to 12 centimeters apart.

Figure 2:
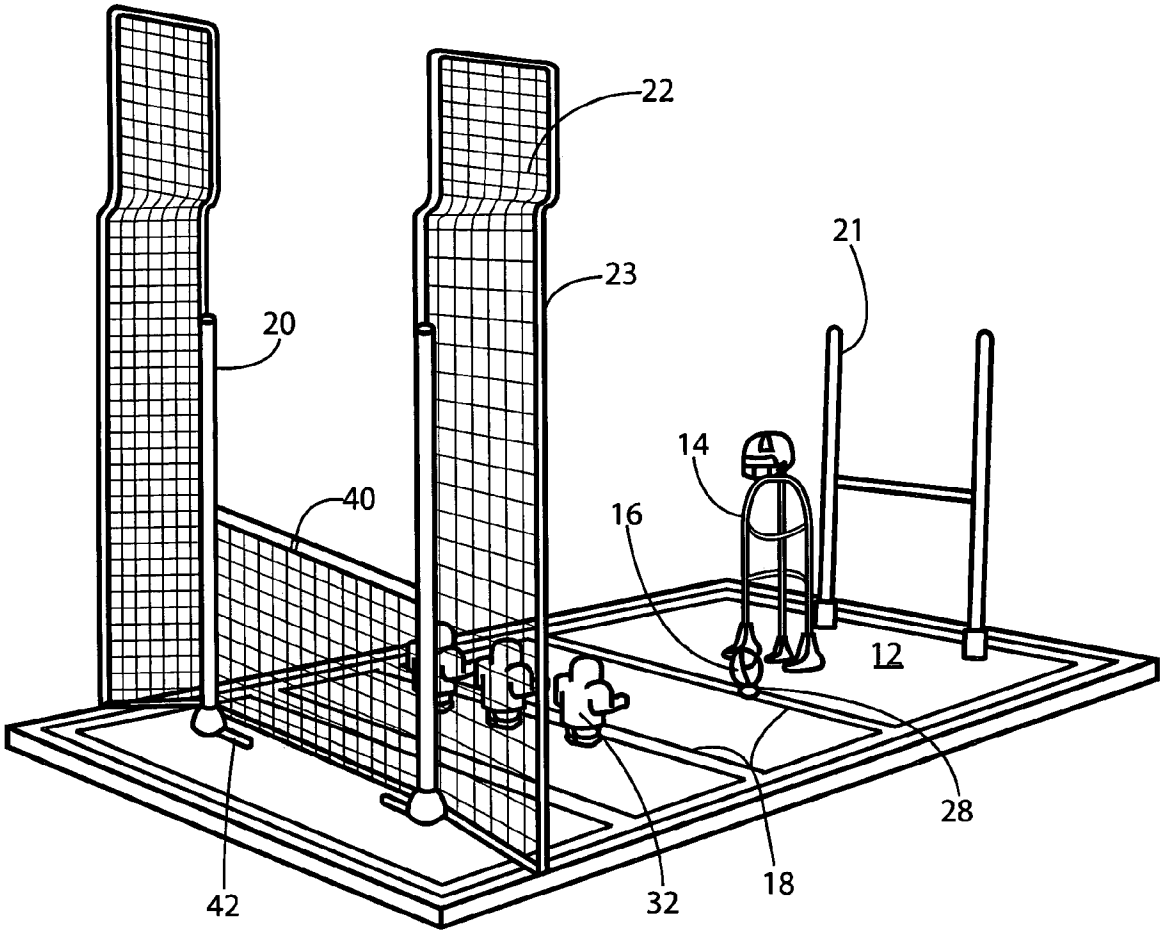
FIG. 2 provides a perspective view of an alternative embodiment of the present invention.

FIG. 2 is a perspective view depicting an alternative embodiment of the present invention. While the size of the playing surface 12 is much the same as that in FIG. 1, the scale of other features is larger. Optional football player FIG. 32 have been placed on the field surface 12 to enhance the appearance. The goal posts 20 and 21 are proportionally bigger than in FIG. 1, and the backstop net 22 and its support 23 are positioned in the same plane as the goal posts 20 and 21. However, an opening 25 is left uncovered by the net to allow the flying ball 16 of successful field goals to pass through while others are repelled by the optional net 22 to clearly indicate whether an attempt is good or not. One end of the ball 16 is placed in a holding tee 28 positioned at one of the lines 18. Preferably, but optionally, a permanent tee 28 would be attached at each of the three lines 18. The mechanical kicker 14 is placed behind the ball 16 and used to propel the ball 16 as shown in more detail in FIG. 3. As opposed to the uprights of goal post 20 and 21 being spaced differently as described above, at least one of the goal posts 20 and 21 can be adjustable in width between 5 and 50 centimeters to add a degree of difficulty to the game. This is most commonly done by using a telescoping crossbar 40 and allowing the feet of the uprights of 20 to slide in notches 42.

Figure 3:
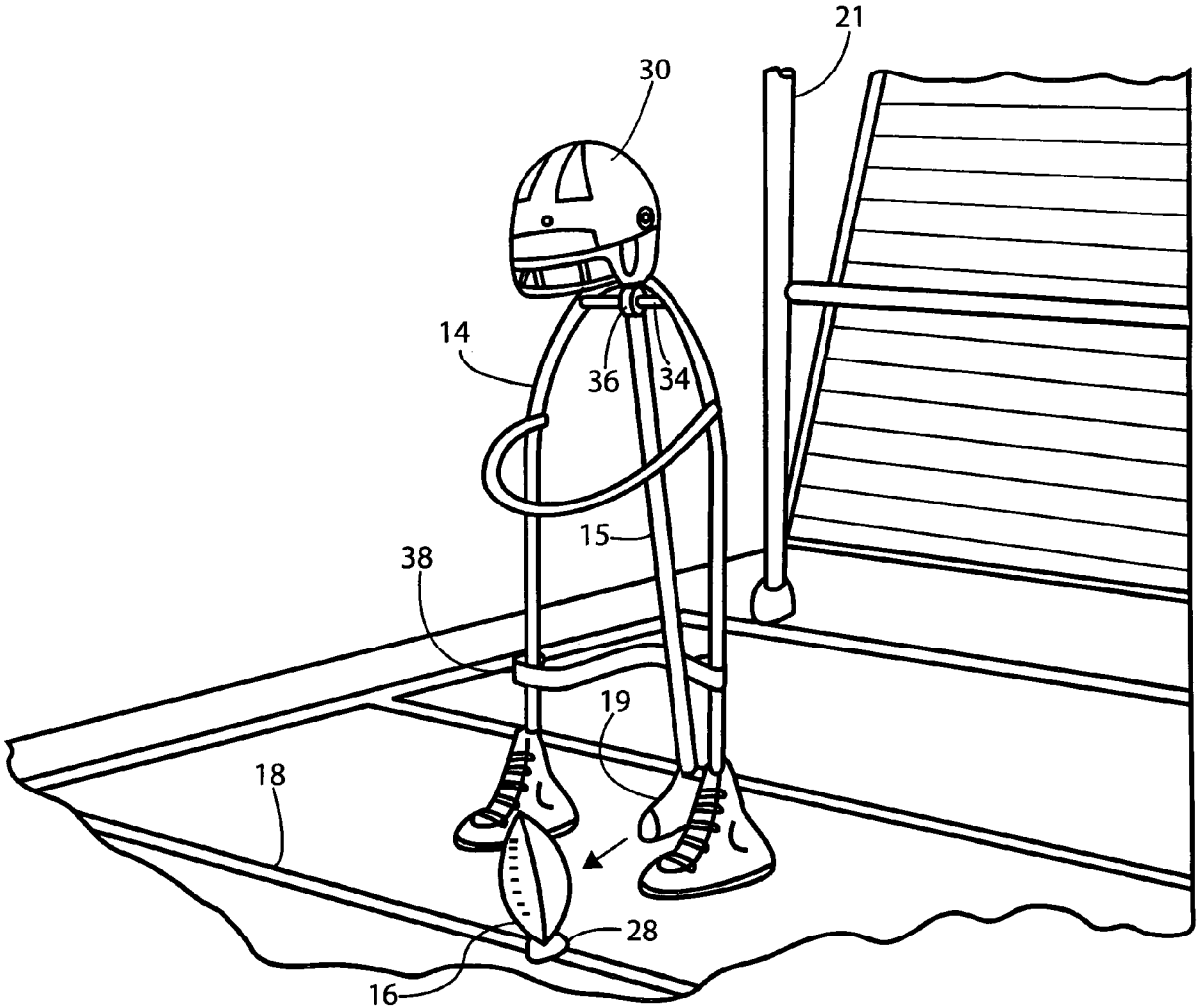
FIG. 3 is a perspective close-up view of the mechanical kicker for miniature footballs.

FIG. 3 is a perspective view showing details of the mechanical kicker 14, which has a substantially U-shaped frame which stands upright with the aid of two feet 13. The pendulum leg 15 has a kicking foot 19 at a free end and is pivotally attached at the opposite end to an axle member 34 by way of a bushing, sleeve or ring 36. An optional helmet 30 enhances the appearance. In use, the player lines up the kicker 14 behind the ball 16 in a manner that he or she believes will propel the ball 16 through the target goal post, not shown in this figure. The pendulum leg 15 is manually drawn back then let go such that the foot 19 strikes the ball 16 sending it up and toward the target goal post. The length of the ball 16 is typically between about one and four centimeters. Preferably, but optionally, a rubber band 38 spans the lower legs of the kicker frame 14 and provides extra impetus to the kicking foot 19. If the ball successfully passes between the uprights and above the crossbar, that player is awarded 3 points and proceeds to the next kicking line. If the kick misses, then the next player or team takes a turn starting at the line closest to the target goal post. Preferably, a multitude of balls come with the game so that a ball does not have to be retrieved after each kick. Two or more can play individually or as teams, and play continues for a designated amount of time or until one player/team reaches a preselected score.

While a presently preferred and various alternative embodiments of the present invention have been described in sufficient detail above to enable a person skilled in the relevant art to make and use the same, it should be obvious that various other adaptations and modifications can be envisioned by those persons skilled in such art without departing from either the spirit of the invention or the scope of the appended claims.

What is claimed is:

1. A table-top football kicking game, comprising:

a) a substantially planar substantially rectangular playing surface having at least two lines extending laterally and spaced at a predetermined distance;

b) at least one set of goal post uprights attached substantially perpendicular to and proximal ends of said rectangular playing surface, said goal post uprights spaced a predetermined width, wherein said predetermined width of said uprights at one end is substantially different from opposing uprights at an opposite end;

c) a toy oblong football having a predetermined length; and d) a kicking means movably engageable with said rectangular playing surface for propelling said toy oblong football off of said playing surface toward said goal post uprights.

2. The table-top football kicking game, according to claim 1, wherein said predetermined length of said toy oblong football is between about one and four centimeters.

3. The table-top football kicking game, according to claim 1, wherein said predetermined spacing of said at least two lines is between about four and twelve centimeters.

4. The table-top football kicking game, according to claim 1, wherein said predetermined width of at least of said goal post uprights is adjustable.

5. The table-top football kicking game, according to claim 4, wherein said predetermined width of said uprights is between about five and fifty centimeters.

6. The table-top football kicking game, according to claim 1, wherein said rectangular playing surface further includes backstops adjacent ends of said rectangular playing surface.

7. The table-top football kicking game, according to claim 1, wherein said rectangular playing surface further includes a score-keeping means adjacent one side edge.

8. A table-top football kicking game comprising:

a) a substantially planar substantially rectangular playing surface having at least two lines extending laterally and spaced at a predetermined distance;

b) at least one set of goal post uprights attached substantially perpendicular to and proximal ends of said rectangular playing surface, said goal post uprights spaced a predetermined width;

c) a toy oblong football having a predetermined length; and d) a kicking means movably engageable with said rectangular playing surface for propelling said toy oblong football off of said playing surface toward said goal post uprights, wherein said kicking means includes a substantially inverted U-shaped frame with a swinging middle leg and foot and two stationary feet.

9. The table-top football kicking game, according to claim 8, wherein said inverted U-shaped frame of said kicking means further includes an elastic band spanning a gap between two legs of said inverted U-shaped frame.

10. A table-top football kicking game comprising:

a) a substantially planar substantially rectangular playing surface having at least two lines extending laterally and spaced at a predetermined distance;

b) at least one set of goal post uprights attached substantially perpendicular to and proximal ends of said rectangular playing surface, said goal post uprights spaced a predetermined width, wherein said goal post uprights are attached to a ball repelling surface extending substantially perpendicular to said playing surface and extending a width of said playing surface in a substantially equal plane with said goal post uprights except for a space between said goal post uprights and above a crossbar;

c) a toy oblong football having a predetermined length; and d) a kicking means movably engageable with said rectangular playing surface for propelling said toy oblong football off of said playing surface toward said goal post uprights.

* * * * *